US010943569B2

(12) United States Patent
Wiener

(10) Patent No.: US 10,943,569 B2
(45) Date of Patent: Mar. 9, 2021

(54) ADAPTER FOR A SUPPORT DEVICE FOR A STRINGED INSTRUMENT

(71) Applicant: DOLFINOS AG, Baden (CH)

(72) Inventor: Michael Wiener, Uttwil (CH)

(73) Assignee: DOLFINOS AG, Baden (SE)

( * ) Notice: Subject to any disclaimer, the term of this patent is extended or adjusted under 35 U.S.C. 154(b) by 29 days.

(21) Appl. No.: 16/306,876

(22) PCT Filed: Jun. 1, 2016

(86) PCT No.: PCT/EP2016/062388
§ 371 (c)(1),
(2) Date: Dec. 3, 2018

(87) PCT Pub. No.: WO2017/207047
PCT Pub. Date: Dec. 7, 2017

(65) Prior Publication Data
US 2020/0243052 A1 Jul. 30, 2020

(51) Int. Cl.

| | |
|---|---|
| ***G10D 3/18*** | (2020.01) |
| ***G10D 3/01*** | (2020.01) |
| ***G10D 1/02*** | (2006.01) |
| *G10G 5/00* | (2006.01) |

(52) U.S. Cl.
CPC ..... *G10D 3/18* (2013.01); *G10D 1/02* (2013.01); *G10D 3/01* (2020.02); *G10G 5/005* (2013.01)

(58) Field of Classification Search
CPC ..... G10D 3/19
See application file for complete search history.

(56) References Cited

U.S. PATENT DOCUMENTS

| | | | | |
|---|---|---|---|---|
| 217,330 A * | 7/1879 | Bull | G10D 3/18 84/279 |
| 627,692 A | 6/1899 | Hoffman | |
| 664,718 A | 12/1900 | Brewster | |
| 1,958,451 A | 5/1934 | Syverston | |
| 2,061,464 A * | 11/1936 | Heimers | G10D 3/18 84/280 |

(Continued)

FOREIGN PATENT DOCUMENTS

| | | | |
|---|---|---|---|
| CA | 3026137 A1 * | 12/2017 | G10D 1/02 |
| DE | 604834 C | 10/1934 | |

(Continued)

OTHER PUBLICATIONS

European Patent Office, International Search Report and Written Opinion of the International Searching Authority in PCT/EP2016/062388, dated Jan. 25, 2017, which is the international application to this U.S. application.

(Continued)

*Primary Examiner* — Robert W Horn
(74) *Attorney, Agent, or Firm* — Kolitch Romano LLP

(57) ABSTRACT

An adapter for mounting a support device for a stringed instrument, such as a violin or a viola. The adapter may include a first bracket having an area for at least partially encircling the tailpiece button of the stringed instrument, a second bracket, and a connecting device. The first bracket and the second bracket are disposed and connected by the connecting device in such a way that the area of the first bracket at least partially encircling the tailpiece button is in stationary contact with the tailpiece button.

20 Claims, 12 Drawing Sheets

(56) References Cited

U.S. PATENT DOCUMENTS

| | | | | |
|---|---|---|---|---|
| 2,486,646 | A * | 11/1949 | Halko | G10D 3/18 84/279 |
| 3,175,446 | A * | 3/1965 | Yehudi | G10D 3/14 84/279 |
| 5,341,714 | A | 8/1994 | Roulet | |
| 6,143,964 | A | 11/2000 | Chen | |
| 6,667,430 | B1 | 12/2003 | Liao | |
| 9,305,528 | B1 * | 4/2016 | Chen | G10D 1/02 |
| 2005/0217455 | A1 | 10/2005 | Ricci | |
| 2009/0114075 | A1 | 5/2009 | Vochezer | |

FOREIGN PATENT DOCUMENTS

| | | | |
|---|---|---|---|
| DE | 836591 | C | 4/1952 |
| DE | 3210739 | A1 | 12/1982 |
| DE | 3216759 | C1 | 12/1983 |
| DE | 4328066 | A1 | 3/1994 |
| DE | 19645519 | A1 | 3/1997 |
| DE | 1917338 | A1 | 9/1997 |
| DE | 19717338 | A1 | 9/1997 |
| DE | 19956211 | A1 | 6/2001 |
| DE | 202006005293 | U1 | 7/2006 |
| DE | 102005037838 | B3 | 8/2006 |
| DE | 102008016521 | A1 | 10/2009 |
| DE | 102012001521 | A1 | 8/2013 |
| EP | 567050 | A1 | 10/1993 |
| GB | 954359 | A | 4/1964 |
| JP | S5387114 | U | 7/1978 |
| JP | 2008064796 | A | 3/2008 |
| JP | 2011514554 | A | 5/2011 |
| WO | 9015406 | A1 | 12/1990 |
| WO | 2004107311 | A1 | 12/2004 |

OTHER PUBLICATIONS

May 13, 2020, Office action of the Japan Patent Office, in Application No. 2019-516053, which is a foreign application corresponding to this U.S. Patent Application.

Oct. 5, 2020, Office action of the Japan Patent Office, in Application No. 2019-516053, which is a foreign application corresponding to this U.S. Patent Application.

* cited by examiner

ADAPTER FOR A SUPPORT DEVICE FOR A STRINGED INSTRUMENT

INTRODUCTION

Adapters for support devices for stringed instruments, in particular for violins, fiddles, and similar instruments, are known and serve to provide a mechanical connection between support and instrument. The member of the support device as a whole serves the purpose of hands-free positioning of the instrument on the musician's body during playing for the purpose of freeing up two hands to play the instrument. The support device usually has rests for supporting the chin, shoulder and chest areas. The chin area is usually disposed on the upper side of the instrument, while the shoulder/chest area is usually disposed on the underside of the instrument. The instrument is clamped in place by being disposed between the chin and the shoulder or the user's chest.

The aforementioned disposition of the instrument at the corresponding points of contact with the human body can lead to physical impairments in the mentioned areas, and this has proven to be problematic. The reason for this is that the conventional support devices cannot be optimally adapted to individual ergonomic-anatomical needs, even though this is necessary because the physical vagaries in the mentioned areas vary from user to user. Likewise, gender-specific differences in physique have not been taken into account so far. This has mainly been due to the fact that to date the focus has primarily been on adapting the respective instrument as best as possible to the user, with the latter's physical circumstances only being of secondary importance. Inadequate adaptation of the instrument to the user makes the instrument more difficult to use and also diminishes the quality of the desired music. For this reason, the present disclosure focuses on adaptation of individual physical vagaries to the respective instrument.

SUMMARY

An object of this disclosure, therefore, is to provide an adapter for a support device at a stringed instrument which establishes a stable and flexible connection between support device and instrument in terms of statics, musical, physiological and medical requirements.

The present disclosure concerns an adapter for mounting a support device for a stringed instrument, in particular for a violin or a viola, comprising: a first component having an area for at least partially encircling the tailpiece button of the stringed instrument; a second component; and a connecting device.

The disclosure further comprises a carrier module, which is connected to an adapter, and a support device for a stringed instrument, comprising at least one support member for placing against the neck/chin/shoulder region of a user, and an adapter connected to the support member.

This object is achieved by an adapter for attaching a support device for a stringed instrument, especially for a violin or viola. The adapter comprises a first component having an area for encircling the tailpiece button of the stringed instrument, a second component and a connecting device. The adapter is characterized in that the first component and the second component are disposed and connected by the connecting device in such a way that the area of the first component encircling the tailpiece button is, at least section-wise, in stationary contact with the tailpiece button.

The adapter establishes a mechanical connection between the support device and the stringed instrument. The connection between the adapter and the instrument is established by attaching it to the tailpiece button of the stringed instrument. The tailpiece button, also called the end button, has the task of receiving the tail gut loop of the tailpiece and directing the force of the strings into the body of the instrument, and it sits positively-locked in a solid end block which is securely glued in the body of the instrument. The described disposition of the end button has no effect on the sound board of the instrument, so that the sound pattern, the sound spectrum and the volume are not impaired. Therefore, attachment of the adapter to the tailpiece button has, for one thing, the advantage of static strength, because, when the violin is used properly, no horizontal tensile forces act on the end button, because it is secured in position by vertical tension of the so-called tail gut. In addition, the load on the sound board is reduced, as a result of which cracks in the wood or the Helmholtz body are prevented. Use of the support accessory also reduces mechanical influence, as a result of which abrasion and damage of the finish are prevented. For another, attachment at the end button does not impair the sound or the volume of the instrument, since the end button has no effect on the sound board due to its positioning.

Attachment proceeds by two components of the adapter, which are connected by a connecting device. As a result of the connection of the two components, an area of the first component encircles the tailpiece button in a stationary manner and thus creates a mechanical connection.

The adapter can have a connector device to which a separate support device can be attached (via a carrier module).

In a preferred embodiment of the disclosure, the adapter is designed for positive-locking attachment to a stringed instrument, wherein the first component and the second component are in contact with the tailpiece button.

The connection is established between the adapter and the instrument by both components via the tailpiece button, a fact which leads to the above-mentioned advantages concerning statics and mechanical properties and does not impair sound quality or volume at all. The positive-locking connection can be achieved through contact of one of the components or through the combined contact of both components. It is conceivable in this regard for contact to be established at two (opposite) sides of the tailpiece button, e.g. from above and below or from left and right.

In a further preferred embodiment, at least the first component and/or the second component makes contact with the back or the top of the stringed instrument. In this regard, the respective other component is in contact with the tailpiece button as described above, and at least encompasses sections of it. With this type of connection, further positioning of the adapter at the upper or lower side of the instrument is created in addition to the positioning at the end button. Positioning on the upper side preferably proceeds on the lower saddle and in the region of the lower saddle/upper edge of the instrument in the top area above the end block. A possible rotational movement around the end button of the adapter is thus effectively prevented. Attachment of the adapter to the violin can also proceed via a clamping action which is produced by the resting component and the component in contact with the tailpiece button (connected by the connecting device).

The connecting device creates an essentially rigid connection between the first component and the second component.

The rigid connection is necessary for establishing a stable and secure connection between the adapter and the instrument, e.g. by encircling or engaging the tailpiece button. This leads to unmediated and direct transmission of force and movement between the instrument and the user, which serves the purpose of unrestricted use of the instrument. In this regard, all conceivable ways of connecting the two components of the adapter can be used, e.g. screwing, latching, clamping, wedging, etc. Particularly preferably, the connecting device of the adapter has at least one screw connection. As a result, on one hand, the two components can be disposed with precision relative to each other and, on the other, permanent fixing of the components to the members of the instrument can be achieved. The distance between the two components can be adjusted with precision for the respective violin or respective tailpiece button.

In an advantageous embodiment of the adapter, provision is made for the first component to have a base and an area in the form of a circular section configured in the base, the radius of said circular section corresponding to the radius of the tailpiece button. The circular area may have a groove which has been adapted to the tailpiece button such that the latter engages with the groove or vice versa. This allows the tailpiece button to rest snugly and stably on the first component and effectively prevents any play on the part of the adapter and consequently any induced movements that interfere with the use of the instrument.

The first component, in a preferred embodiment, has at least a first attachment section for connection to the connecting device and/or a second attachment section for connection to the connecting device.

The attachment sections of the first component have corresponding members for connection to the inventive connecting devices, such as receptacles, bores, recesses, etc.

Thus, in a particularly advantageous embodiment of the disclosure, the first attachment section and/or the second attachment section may each have at least one passage with an internal thread for receiving the connecting device.

Through the use of a connecting device having a corresponding counter-thread, e.g. in the form of a screw, targeted disposition and subsequent fixing and secure locking of the first component can be achieved.

In a further preferred embodiment of the inventive adapter, the first component is essentially U-shaped.

The U-shape serves to accommodate an area of the tailpiece button and prevents play.

Preferably, the second component is designed like a bracket for resting on the top or the back of the stringed instrument.

The bracket or the resting section of the second component rests on the upper or the lower side of the stringed instrument. In the case of positioning on the upper side, this occurs preferably on the lower saddle and in the region of the lower saddle/the upper edge of the instrument in the top area above the end block. Positioning on the upper and lower side, together with the resting of the end button on the area of the first component, makes for stable positioning of the adapter. To firmly hold the adapter to the instrument, a certain tensioning of the first component relative to the second component can be created by adjusting the connecting device accordingly.

In a particularly advantageous embodiment, the second component has a third and/or fourth attachment section for connecting to the connecting device.

The resting section is connected to the third attachment section and to the fourth attachment section. With regard to the third and fourth attachment sections, the above considerations concerning the first and second attachment section apply correspondingly. The sections have members for connecting to the connecting devices, e.g. receptacles, holes, recesses, etc. The resting section offers a support on the upper or lower side of the stringed instrument.

The third attachment section and the fourth attachment section each have at least one passage with an internal thread for accommodating the connecting device.

In this regard, what was said above about the first and second attachment sections applies accordingly, whereby a counter-thread, e.g. in the form of a screw, can achieve targeted disposition, fixing and secure locking to the second component.

In a preferred embodiment of the inventive adapter, the second component has an area for making contact with the tailpiece button of the stringed instrument, wherein the first component and the second component are disposed and connected by the connecting device in such a way that the area of the second component is in stationary contact with the tailpiece button.

Both components have areas for allowing contact with the tailpiece button, wherein the area of the first and the second components is in stationary contact. Usually the adjustment of the tailpiece button proceeds from two sides, e.g. from above and below. Use of the connecting member enables the two components to be disposed facing each other with respect to the end button, and the distance can be adjusted and fixed. The contacting of the tailpiece button between the two components creates a play-free connection between the adapter and the instrument.

In a preferred embodiment, the second component of the inventive adapter has an area for at least encircling a section of the tailpiece button of the stringed instrument, wherein the first component and the second component are disposed and are connected by the connecting device in such a way that the second area of the second component encircling the tailpiece button is in stationary contact with the tailpiece button.

In addition to the first component which is in contact with or encompasses the tailpiece button, the encircling of the area of the second component enables a stable, play-free connection between adapter and instrument. It is also possible for the end button to be encircled by both components from two sides, e.g. from above and below or from left and right. In the latter case, the components would be disposed on the left and right sides of the tailpiece button.

In a further embodiment of the disclosure, the adapter has an upper, middle and lower section, wherein the upper section is configured to rest on the top of the stringed instrument, the lower section to rest on the back of the stringed instrument, and the middle section serves to connect the upper and lower sections.

The adapter can be monolithic or, in line with the above-mentioned embodiments, comprise two or more components as described above, or the individual sections may comprise individual components.

Preferably, the lower section of the adapter is disposed at the back of the instrument. The middle section may have a recess for the tailpiece button. The tailpiece button in this regard either is not touched or no mechanical connection is established between the receiving member and the tailpiece button. Besides the described recess, other forms of the adapter for enclosing the tailpiece button without touching it are conceivable.

The upper section serves to rest the adapter on the top of the instrument. Preferably, resting of the adapter takes place on the lower saddle and in the region of the lower saddle/ upper edge of the instrument in the top area above the end block. There are several conceivable ways to do this with regard to the attachment and shape of the upper section. Attachment to the top can proceed by clamping, latching, positive-locking or similar method. The shape of the contact surface can be configured, e.g., so as to span the entire width of the adapter or only punctiform, e.g. with the aid of appropriate hooks. This makes it clear that the upper section does not have to be designed as a continuous part. In the case of a continuous design, the area of the middle section recessed for the tailpiece button can be completed by the upper section. However, it is also possible for the U-shaped recess to remain upwardly open and for the support of the upper section to be provided by two brackets or hooks.

In the case of a multi-piece embodiment, the adapter has a connecting device, whereby the individual sections are disposed and connected by the connecting device in such a way that the lower section makes contact with the back and the upper section with the top of the stringed instrument. In accordance with the above-mentioned embodiments, all conceivable ways of connecting the sections of the adapter, such as screwing, locking, clamping, wedging, etc., can be considered possible connecting devices. Particularly preferably, the connecting device of the adapter has at least one screw connection. As a result, on one hand, the precise disposition of the sections of the adapter towards each other can be adjusted and, on the other, the adapter can also be permanently and individually fixed to the instrument. The adapter is characterised in a special embodiment by the fact that the upper section is designed as an attachment member, wherein the member has a rounded E-shape for at least partially encircling the lower area of the tailpiece of the stringed instrument.

In particular, the upper section can be of a bracket-like design, wherein the central part of the bracket is attached to the middle section and the two arms extending from the middle section extend out of the plane of the middle section onto the top of the violin (in particular also over the edge web of the top of the violin body) in order to create a clamping effect or to be attached to the violin body in a positive-locking manner.

For one thing, the profile of the attachment member serves as a support on the top of the instrument. The attachment member can have a rounded profile that adapts to the curvature of the rib of the top of the instrument and thus creates a stable connection. For another, the bracket shape or the rounded E shape serves the purpose of encircling the lower end of the tailpiece. Thus the adapter can easily be adjusted and attached to the violin body.

A carrier module, e.g. in the form of a neck part, can be configured (monolithically) with an adapter or with one of the components of the adapter. In alternative embodiments, the adapter can have one or more connectors to which a separately configured carrier module (removable) can be attached, e.g. by way of a plug-in/locking connection.

The object is also achieved with a carrier module which is connected to an adapter as described above, whereby it is adjustable in height and suitable for the disposition of support members.

The carrier module serves on one hand to accommodate support members for the user's chest, chin and shoulder area and on the other to adapt to the individual length of the neck. The carrier module can be attached to the adapter by suitable connection methods such as screwing, latching, clamping, etc.

In addition, the carrier module is preferably height-adjustable in order that it may adapt to the individual neck length of the user. The carrier module comprises, e.g., two parts, one of which is height-adjustable by way of a linear guide of the other part. The desired height can be adjusted and locked by way of a spring-locking mechanism. The individual height is fixed, e.g. with a lateral screw.

Well-known members for resting on the chin, chest and shoulder can serve as support members which are provided with appropriate padding to enable adaptation to individual physical vagaries.

The present disclosure also discloses a support device for a stringed instrument which includes at least one support member for placing against the neck/chin/shoulder area of a user, said support member being connected to an aforementioned adapter.

The support member serves to provide a holding and supporting function and the possibility of adaptation to the musician in respect of individual body shape of the chin, chest, shoulder and chest-chin angle. With regard to the supporting the chin and the chest/shoulder area, the support member has padding or elastic material to protect the skin and the underlying muscles of the user and to protect them from excessive pressure. The chest support and shoulder support can be adjusted to fit the individual body shape.

DETAILED DESCRIPTION

The following examples and the figures on which they are based clearly show the structure of adapters according to the present disclosure.

Figure 1:
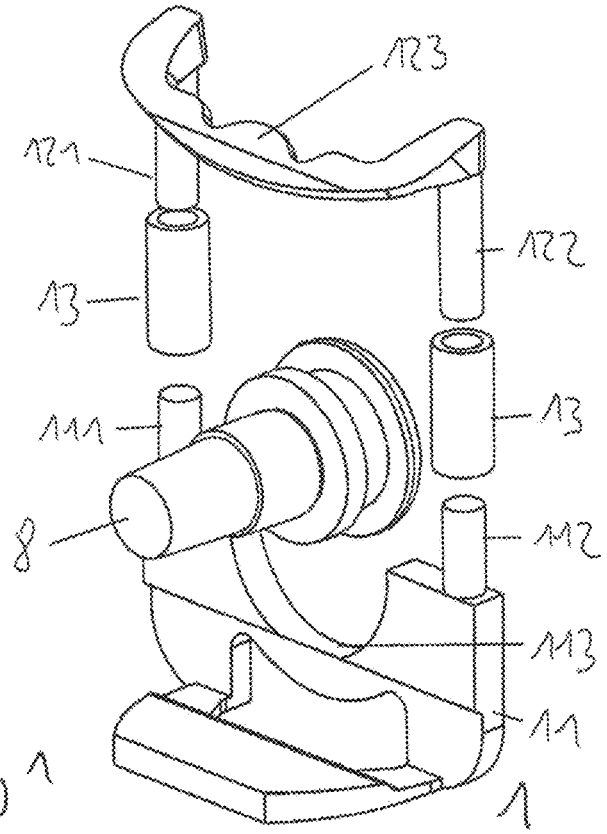
FIG. 1 is an isometric view of an illustrative adapter with a first lower component in the form of a back bracket and a second upper component in the form of a lower saddle bracket. The lower saddle bracket has a rounded E-shape, as a result of which the lower and lower side areas of the tailpiece of the instrument are encircled when the attachment member is attached to the stringed instrument. The lower saddle bracket and the back bracket have screw zones which are connected by two screw sleeves. View from the instrument.

FIG. 1 shows an adapter 1 comprising two components 11, 12. The first component 11 is a back bracket and is essentially U-shaped and has an area 113 which serves to support and encircle a section of the end button 8 In addition, the first component has an area that serves as a support at the back of the instrument. The first component 11, has on its outer sides receptacles 111, 112 in the form of external threads for attachment devices. The second component 12 is in the form of a lower saddle bracket 123 and serves to rest on the upper side or top of the instrument. The second component 12 has a rounded E-shape 123, as a result of which mounting to the tailpiece is simplified. This serves, for one thing, the purpose of resting on the instrument while, for another, the limbs of the E-shape encircle the tailpiece. Due to the rounded E-shape 123, the lower area of the tailpiece is encircled at three points (at the bottom and on both sides). The second component 12 can also be bracket-shaped overall. The rounded outer limbs of the E-shape or of the bracket are bent towards the axis of symmetry and rounded. The middle limb of the "E" is shortened. In addition, the free end sections of at least the outer limbs are bent out of one plane so that they overlap an edge web protruding beyond the upper side of the stringed instrument and so the adapter 1 can be securely fixed. To this end, the shape is adapted to allow the second component 12 to be "threaded" as easily as possible around the tailpiece.

The second component 12 also has on its outer sides receptacles 121, 122 for attachment devices in the form of external threads. Both components 11, 12 are disposed towards each other by suitable connecting devices 13, in this case two counter-rotating screw sleeves with internal threads, and connected to each other as a result of the threaded connection. In this regard, the tailpiece button 8 rests on the U-shaped area 113 and, due to the connection with the second component 12, is engaged. The second component 12 rests on the upper side or top of the instrument and creates a stable connection between the components and the instrument. The first component 11 is in contact with the back of the instrument. Due to the positioning on the upper side, resting occurs preferably on the lower saddle and in the region of the lower saddle/upper edge of the instrument in the top area above the end block. Due to the positioning at the upper or lower side of the instrument, twisting or a rotary movement of the adapter 1 around the end button 8 is suppressed.

Figure 2:
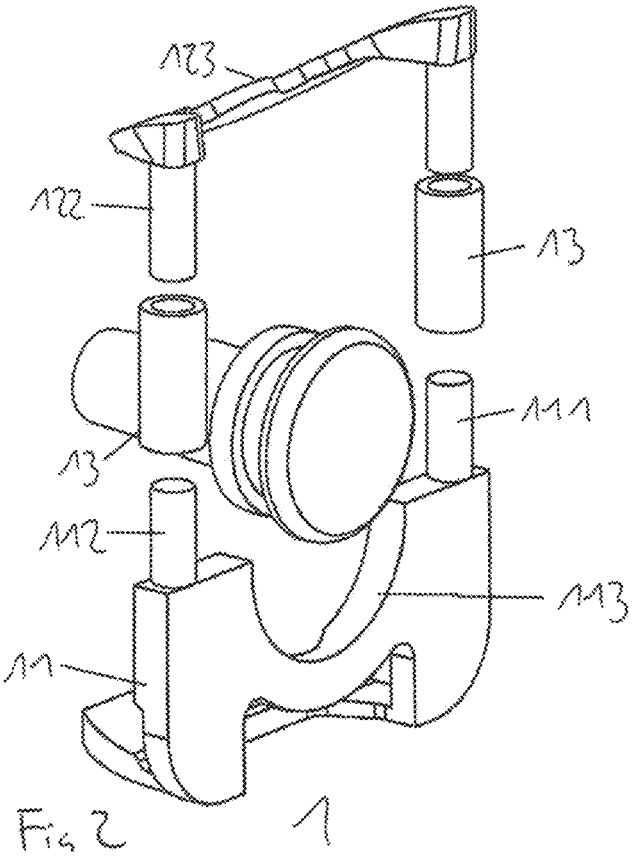
FIG. 2 is an isometric view of the adapter of FIG. 1; view towards the instrument.

FIG. 2 shows the adapter 1 described above from the opposite side, i.e. looking towards the instrument, of which only the tailpiece button 8 is shown.

Figure 3:
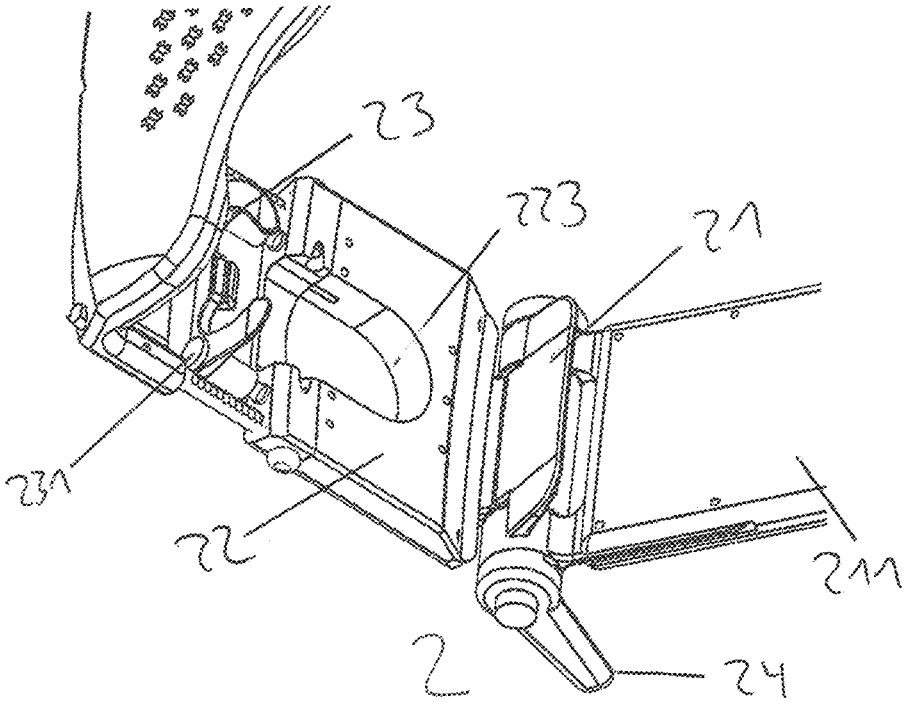
FIG. 3 is an isometric view of an illustrative adapter with an upper (lower saddle bracket), middle (middle part), and lower section (back bracket). The middle part has a recess for receiving the tailpiece button. The back bracket is configured to rest on the back of the stringed instrument and has a flap for the chest.

FIG. 3 shows a further embodiment of the adapter. The adapter 2 has an upper section in the form of a lower saddle bracket, a middle section 22 and a lower section 21 in the form of a back bracket, wherein the middle section 22 has a recess 223 for the tailpiece button 8 of the stringed instrument. The middle section 22 may also have a different shape and need not necessarily contain a recess. These sections may be monolithic or multi-piece and may, in the latter case, be interconnected by appropriate connecting members. The recess in the middle section 22 is essentially U-shaped to accommodate the tailpiece button 8. As a result, the adapter 2 can be mounted flush with the rib of the instrument and the end button 8 is accommodated in area 223 without making contact. The upper section 23 is attached to the middle section 22 and has the rounded E-shape already described above, as a result of which mounting to the tailpiece is simplified. The lower section 21, or back bracket, is essentially L-shaped and has a flap 211 for attaching a support element for the user's chest or clavicle. The horizontal limb of the "L" is suitable for resting on the back of the instrument. The adapter 2 also has a member 24 for adjusting and locking the angular position of the middle section 22 to the flap 211. The middle section 22 has receiving members in the form of sleeves 224, 225 for receiving a chin rest.

In the case of the multi-piece embodiment, adapter 2 has on its outer sides receptacles 221, 222 for connecting devices, e.g. screws. The mutual alignment and locking of the sections of the adapter 2 can be effected, for example, by way of a screw connection on the upper section 23, as a result of which the lower 21, middle 22 and upper section 23 are positioned correctly relative to each other and with regard to the disposition on the instrument.

Figure 4:
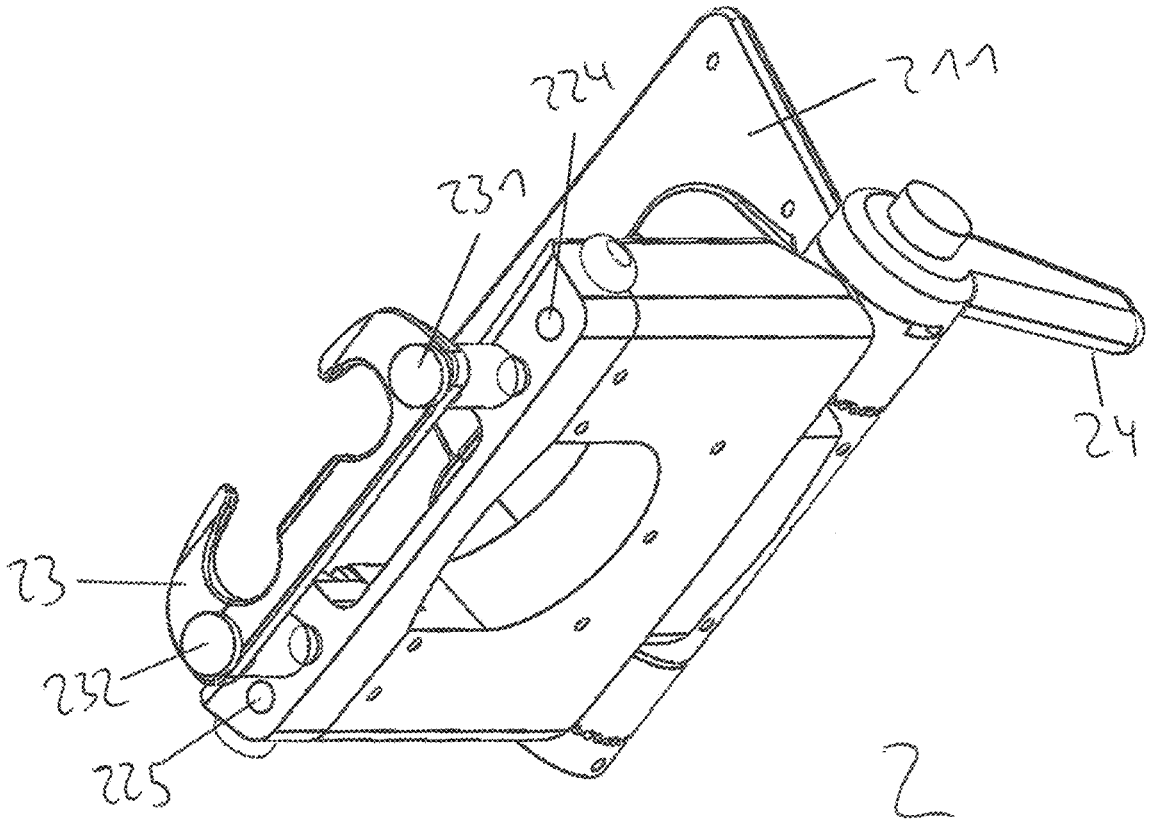
FIG. 4 is an isometric view of the adapter of FIG. 3; view towards the instrument (indicated by tailpiece)

FIG. 4 shows the previously described adapter 2 of FIG. 3 looking towards the instrument, of which only the end button 8 is shown.

Figure 5:
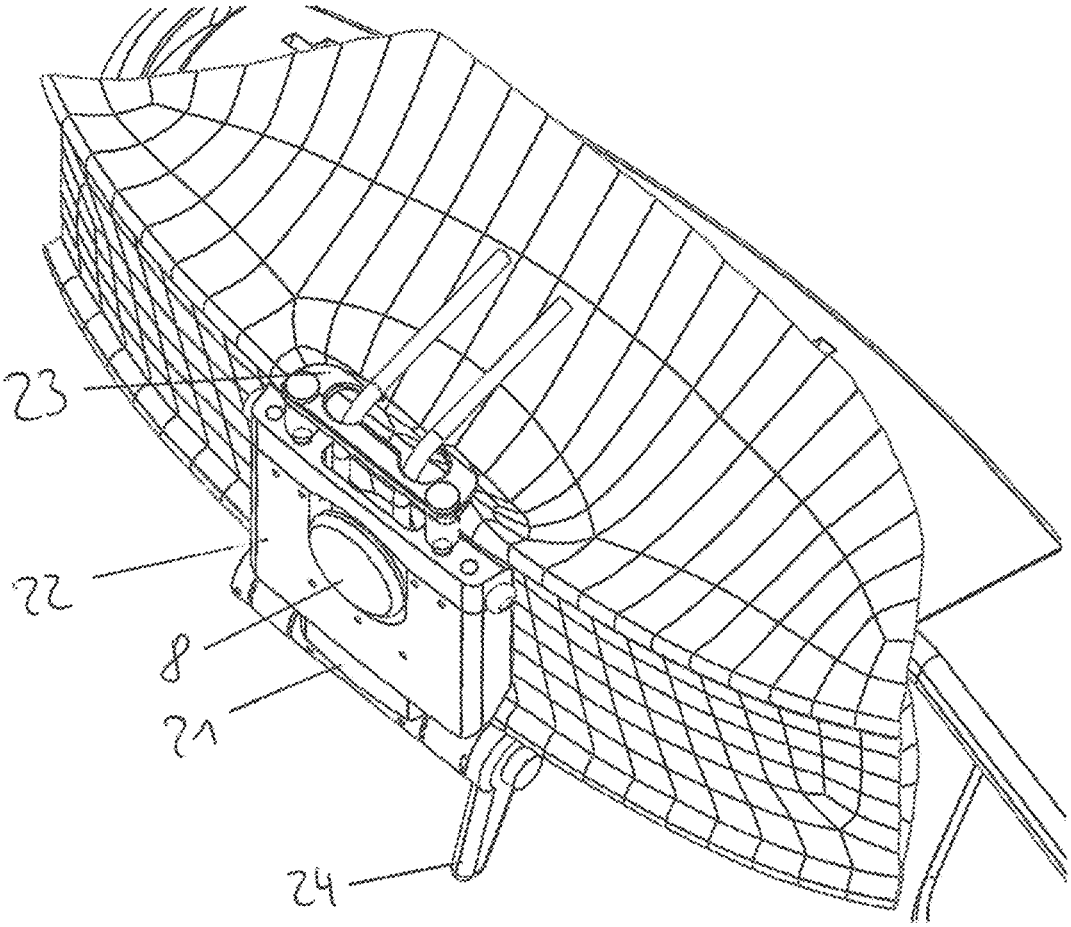
FIG. 5 is an isometric view of a mounted adapter of FIGS. 3 and 4, showing an upper side of a violin. The tailpiece is located in the recess of the middle section without touching it. The tailpiece cords are encircled by the upper component.

FIG. 5 shows the adapter 2 attached to a violin, in which the tailpiece button 8 is inserted into the recess 223 of the middle section 22 without touching it. To mount the adapter 2, the lower section 21 is placed against the bottom rib of the violin and the tailpiece button 8 is disposed in the recess 223 without touching it. Through use of the connecting devices, the sections of the adapter 2 are disposed towards each other, wherein the lower section 21 is attached to the back or the bottom rib and the upper section in the form of the attachment member 23 is attached to the top rib of the violin. This is preferably done in the region of the lower saddle. As a result, a stable connection is obtained between adapter 2 and the instrument. As a result of the rounded E-shape of the attachment member 23, the tailpiece cords are enclosed.

Attachment therefore proceeds at the upper and lower sides of the instrument, wherein the tailpiece button 8 is not touched. Due to the tensioning or the distance between the attachment member 23 and the lower section 21 of the adapter 2, or due to the positive-locking attachment of the adapter 2 to the violin body, the adapter 2 is securely attached to the resonance body of the stringed instrument.

Figure 6:
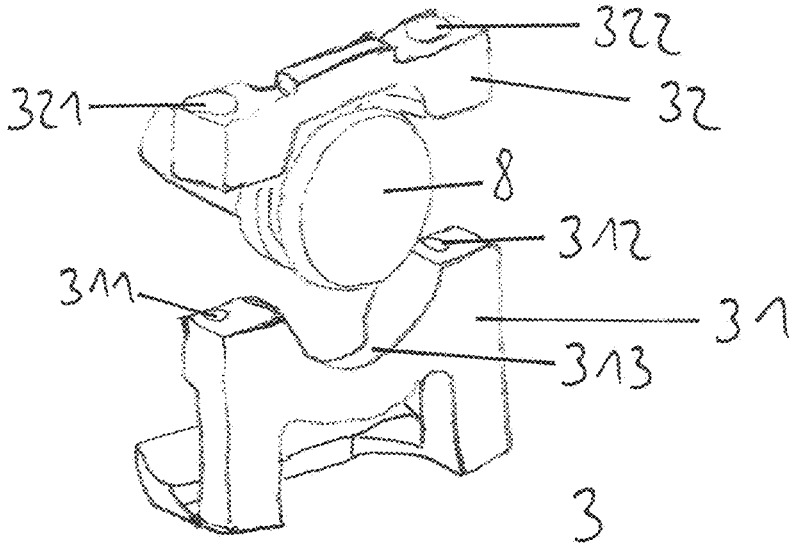
FIG. 6 is an isometric view of an illustrative adapter wherein one component comprises a bracket and a U-profile for resting on the tailpiece button from below and the bracket is suitable for resting on the back of the instrument and the other component is in the form of a bracket for resting on the upper side of the instrument. Both components have receptacles and passages for corresponding connecting members. The violin's ribs may be engaged by the two components from above and below.

FIG. 6 shows a second embodiment of the adapter. The adapter 3 comprises a first lower component 31 in the form of a back bracket and a second upper component 32. The first component 31 is essentially in the form of a bracket and has a U-shaped receiving area 313, which serves to receive a first section of the tailpiece button 8. The bracket shape of the first component 31 serves as a support at the back of the instrument. The first component 31 has on its outer sides receptacles 311, 312 for connecting devices (not shown). The second component 32 has an area 323 for receiving a further, second section (opposite the first section) of the end button 8. The second component 32 also has on its outer sides receptacles 321, 322 for attachment devices. Through use of the connecting devices, the two components are disposed towards each other and the end button 8 is positively engaged between the two support areas 313, 323 of the two components. This ensures a stable connection between the adapter 3 and the instrument. Attachment proceeds at the tailpiece button 8 and the back of the instrument.

Figure 7:
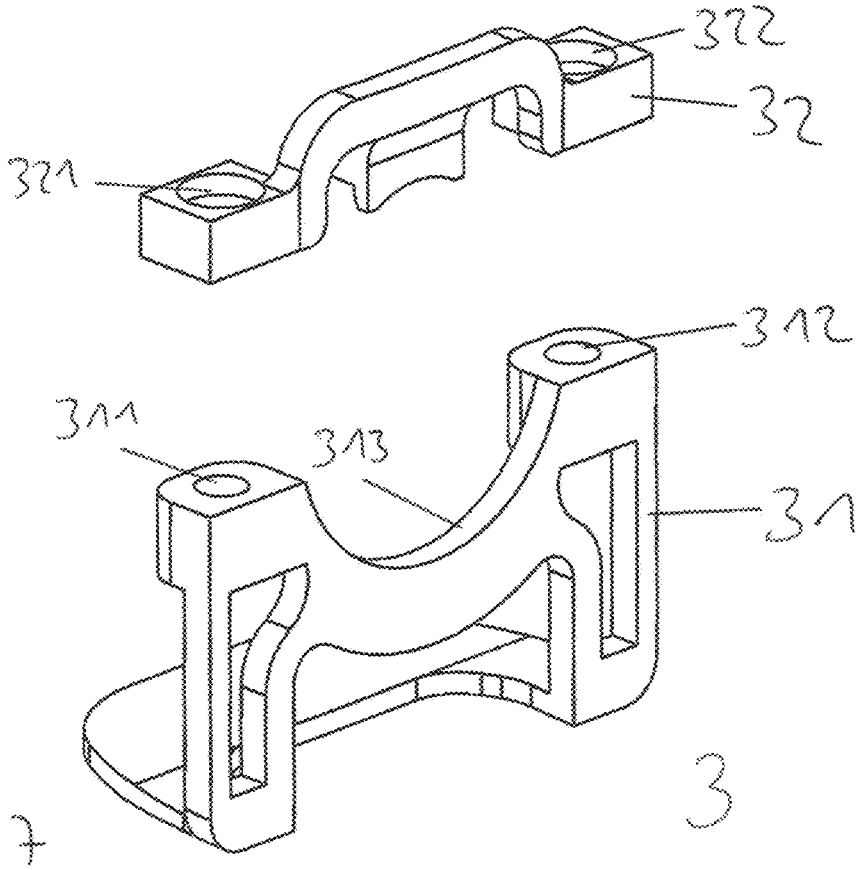
FIG. 7 is an isometric view of the adapter according to FIG. 6; shown without end button.

FIG. 7 shows the adapter 3 of FIG. 6 but without the end button. The receiving area 323 for the end button is clearly visible on the upper second component 32.

Figure 8:
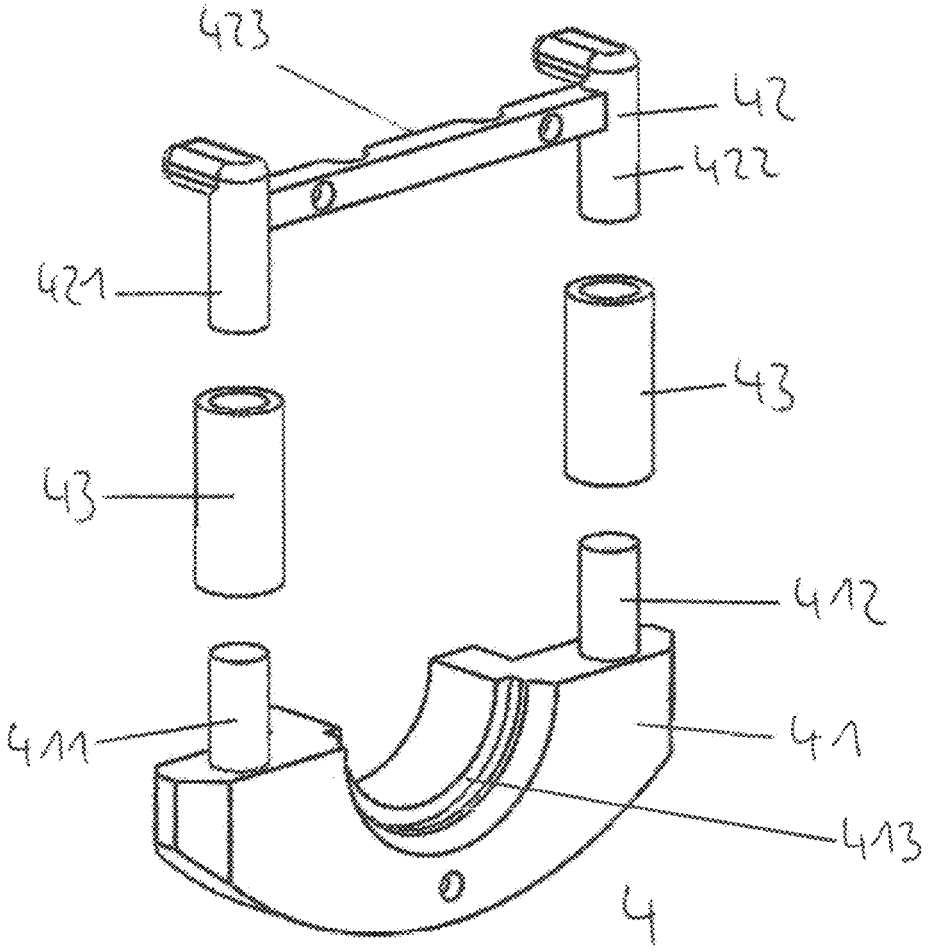
FIG. 8 is an isometric view of an illustrative adapter, wherein one component is essentially U-shaped and has a U-profile for supporting the tailpiece button from below and the other component is in the form of a bracket with rib feet for resting on the upper side of the instrument. Both components have receptacles and passages for corresponding connecting members.

FIG. 8 shows a further embodiment of the adapter. Adapter 4 comprises two components 41 and 42. The first component 41 is essentially U-shaped and has an area 413 which serves to support and encircle a section of the end button 8 (not shown). The first component 41 has on its outer sides receptacles 411, 412 in the form of external threads for attachment devices. The second component 42 is configured in the form of a lower saddle bracket 423 with rib feet and serves as a support on the upper side or top of the instrument. The second component 42 also has on its outer sides receptacles 421, 422 for attachment devices in the form of external threads. Both components 41, 42 are disposed towards each other by way of suitable connecting devices 43, in this case two counter-rotating screw sleeves with internal threads, and are connected to each other by way of the threaded connection. The tailpiece button 8 rests on the U-shaped area 413 and, due to the connection with the second component 42, is engaged. The second component 42 rests on the upper side or top of the instrument and creates a stable connection between the components and the instrument. Due to the positioning on the upper side, resting occurs preferably on the lower saddle and in the region of the lower saddle/upper edge of the instrument in the top area above the end block. Due to the positioning at the upper or lower side of the instrument, twisting or a rotary movement of the adapter 4 around the end button 8 is suppressed.

Figure 9A:
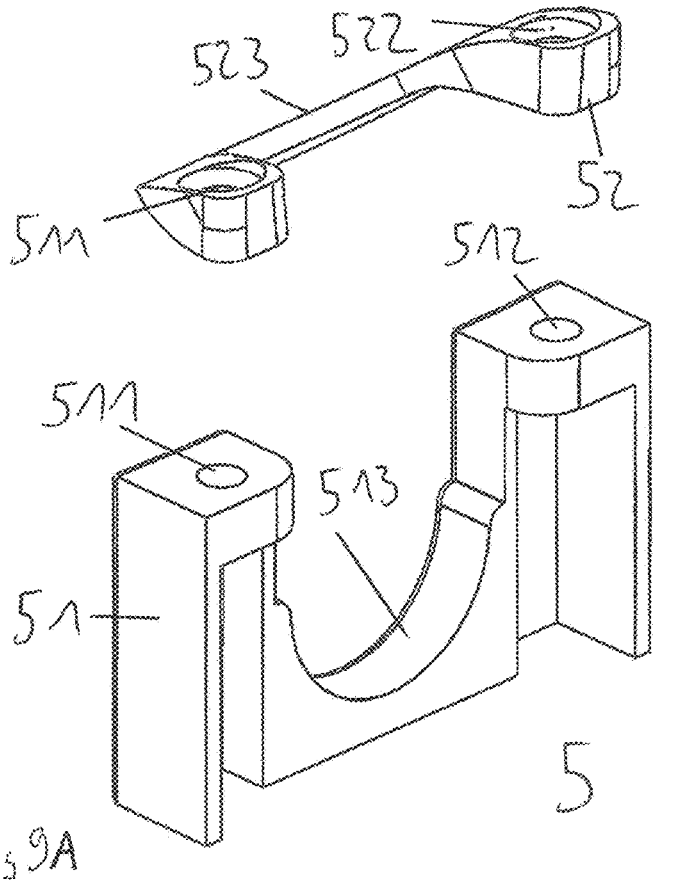
FIG. 9A is an isometric view of a first variant of the adapter in FIG. 8.
Figure 9B:
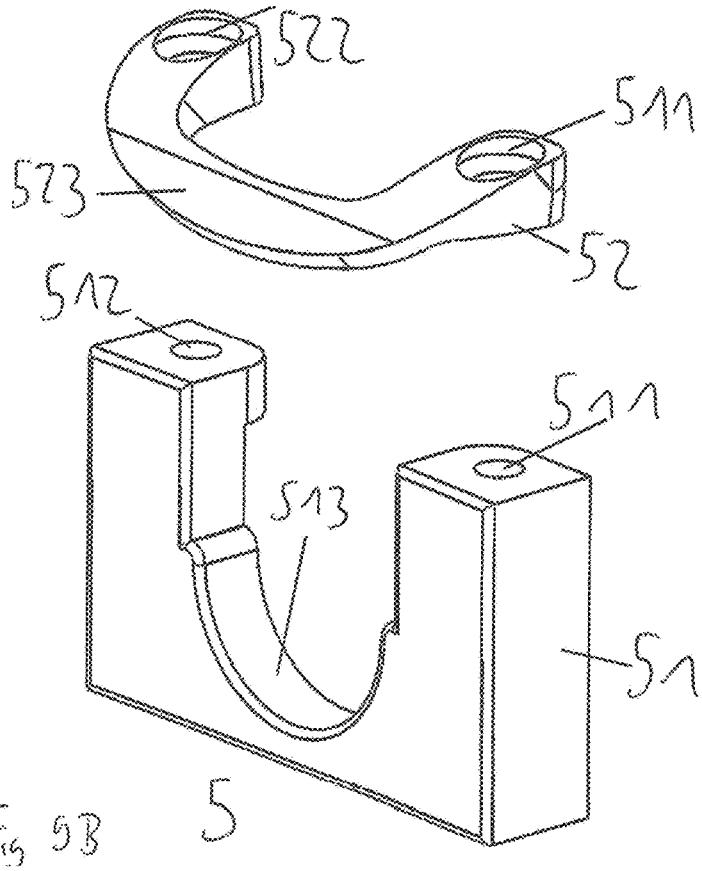
FIG. 9B is an isometric view of a second variant of the adapter of FIG. 8.

FIGS. 9A and 9B show a variant of adapter 4 looking away from the instrument (FIG. 9A) and looking towards the instrument (FIG. 9B). The first component 51 of the adapter has on its outer sides receptacles 511, 512 for attachment devices. The second component 52 is configured in the form of a closed lower saddle bracket 523 and serves as a support on the upper side or the lower saddle of the instrument. The second component 52 also has on its outer sides receptacles 521, 522 for connecting devices (not shown). Both components 51, 52 are connected to each other by suitable connecting devices (not shown).

Figure 10:
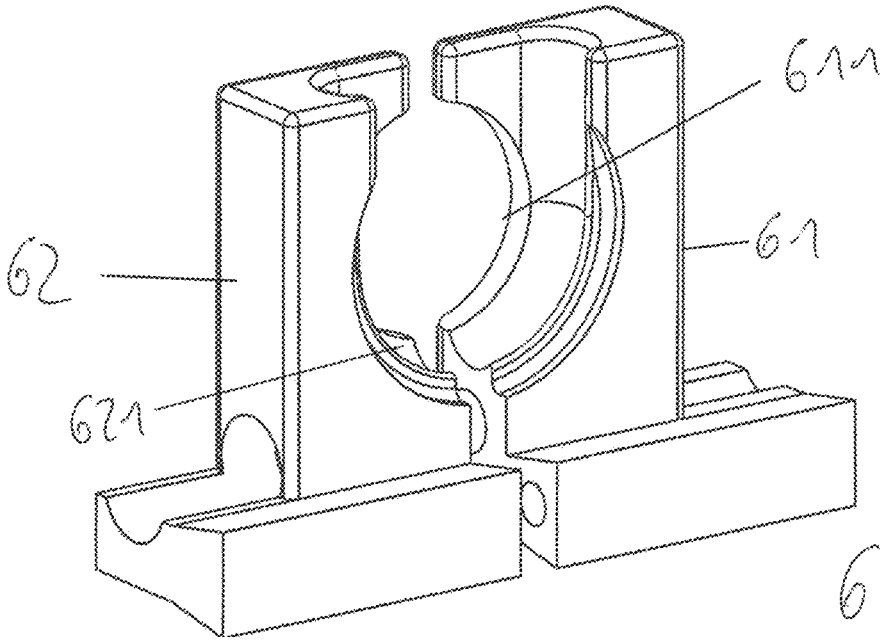
FIG. 10 is an isometric view of an illustrative adapter, wherein the tailpiece button is encompassed by both components.

FIG. 10 shows a further adapter 6 having two components 61, 62 in the form of two similarly shaped clamping parts, each having an area 611, 621 for the tailpiece button 8 (not shown) to rest on. The areas are adapted to the shape of the tailpiece button 8. Both components 61, 62 are drawn together around the tailpiece button 8 of the stringed instrument from two sides and then locked in place. The drawing together and locking can be done, e.g., by way of a screw connection or a wedge connection (neither of which is shown). In the latter case, the two components 61 and 62 can be correctly positioned relative to each other by tightening the wedge. In this embodiment, too, attachment proceeds only at the tailpiece button 8, without touching the rest of the instrument body. The advantage of this is that the connection has no negative effect on the sound board of the instrument, and that the sound and volume are not impaired.

Figure 11:
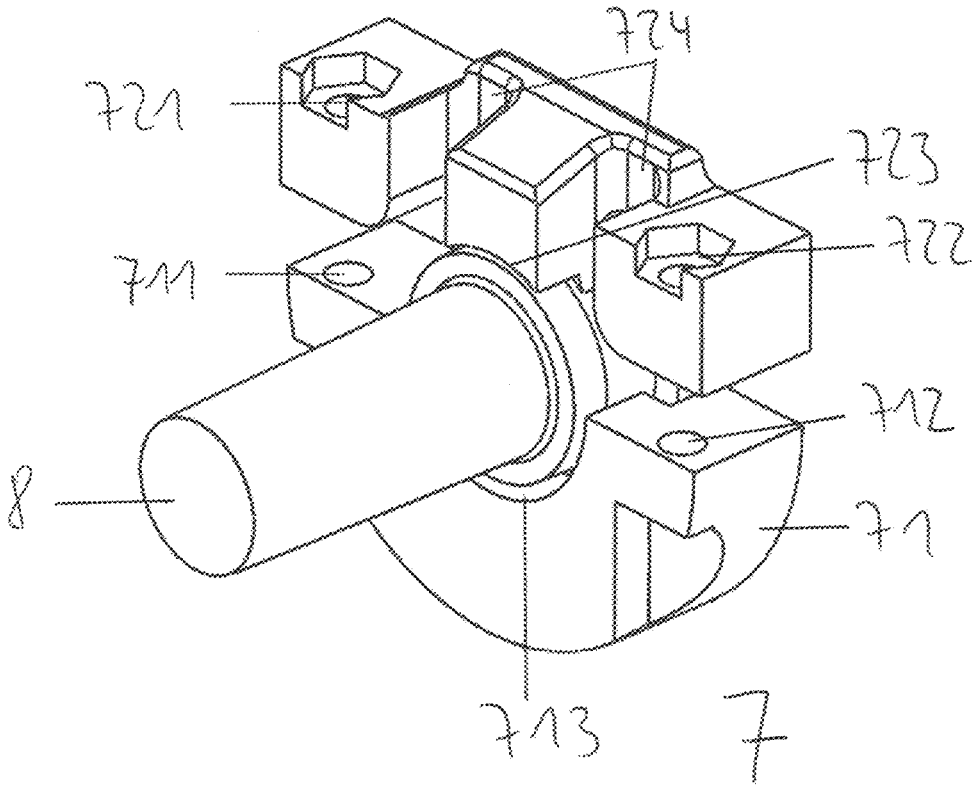
FIG. 11 is an isometric view of an illustrative adapter, wherein the tailpiece button rests on an area of a U-shaped component and, through resting, on an area of the other component. Both components have receptacles and passages for corresponding attachment members; view from instrument.

FIG. 11 shows a further variant of the adapter. The first component 71 is essentially U-shaped and an area 713 serves to accommodate the first section of the tailpiece button 8. The first component 71 has on its outer sides receptacles 711, 712 for connecting devices (not shown). The second component 72 has an area 723 for receiving a further second section (opposite the first section) of the end button 8 and has two recesses 724 for tailpiece cords. The second component 72 also has on its outer sides receptacles 721, 722 for attachment devices. Through use of the connecting devices, the two components are disposed towards each other and the end button 8 is positively engaged between the two support areas 713, 723 of the two components. This ensures a stable connection between the adapter 7 and the instrument. Attachment proceeds solely at the tailpiece button 8 without touching the rest of the violin body. The advantage of this is that the connection has no negative effect on the sound board of the instrument and the sound and volume of the instrument are not impaired.

Figure 12:
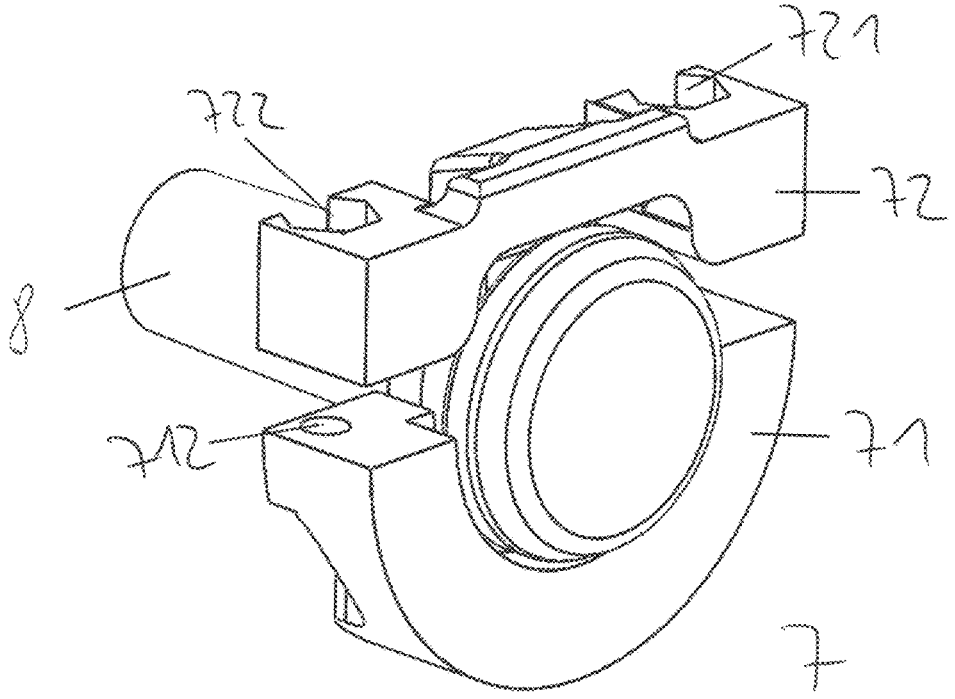
FIG. 12 is an isometric view of the adapter of FIG. 11; view towards the instrument.

FIG. 12 shows the previously described adapter 7 from the opposite perspective, i.e. looking towards the instrument (represented by end button 8).

Figure 13:
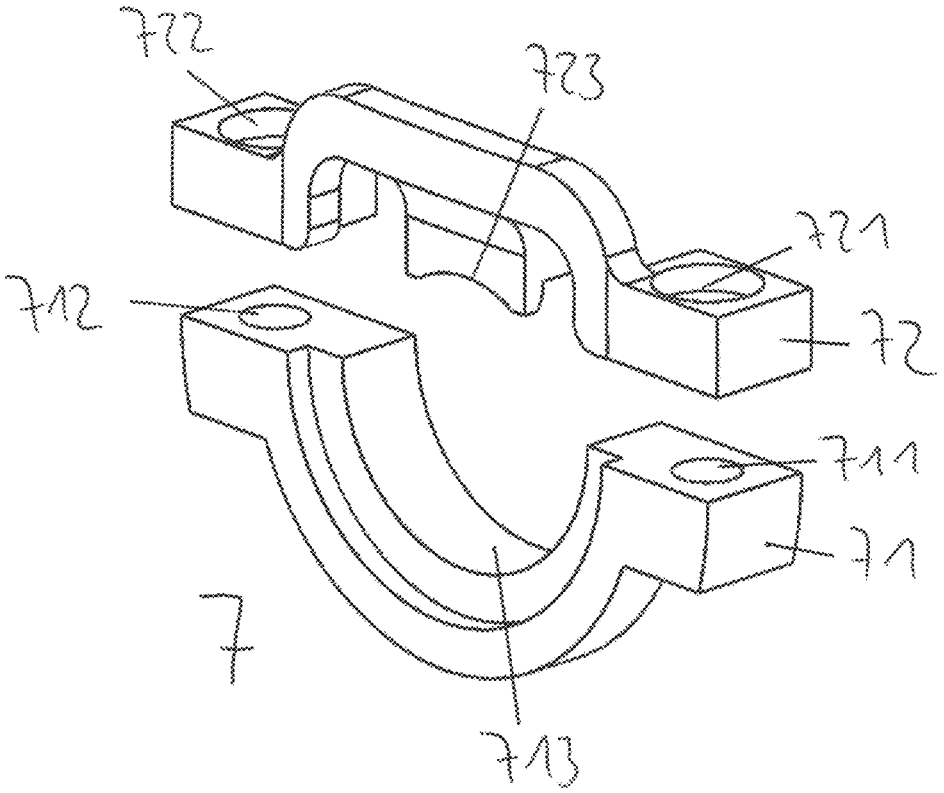
FIG. 13 is an isometric view of a variant of the adapter according to FIGS. 11 and 12 in slimmer form.
Figure 14:
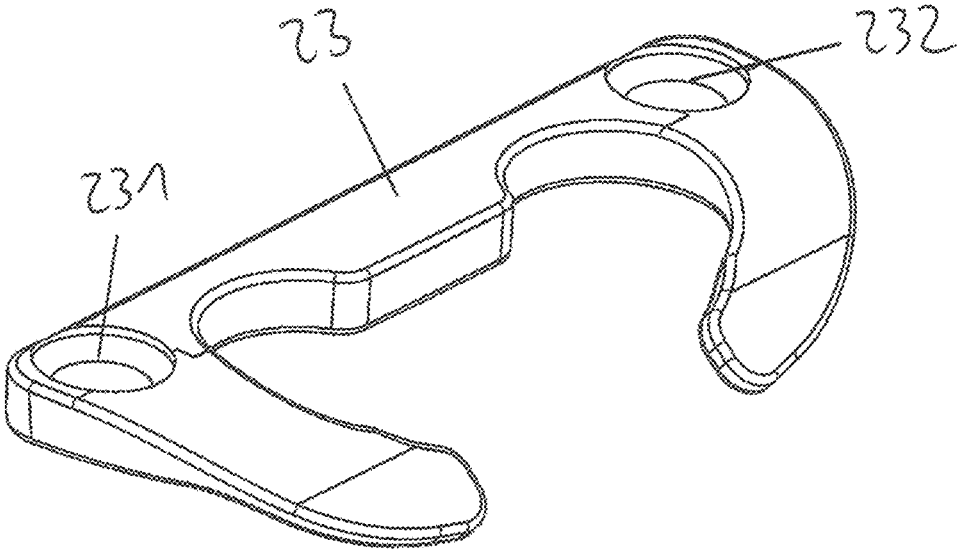
FIG. 14 is an isometric view of an upper section of an illustrative adapter in the form of an attachment member for attachment to the lower saddle, said member having a rounded E-shape, wherein the lower and lower side areas of the tailpiece of the instrument are encircled when the attachment member is attached to the stringed instrument (upper drawing). Upper section of the adapter in the form of an attachment member in closed form which is passed under the tailpiece cords (lower drawing)
Figure 14:
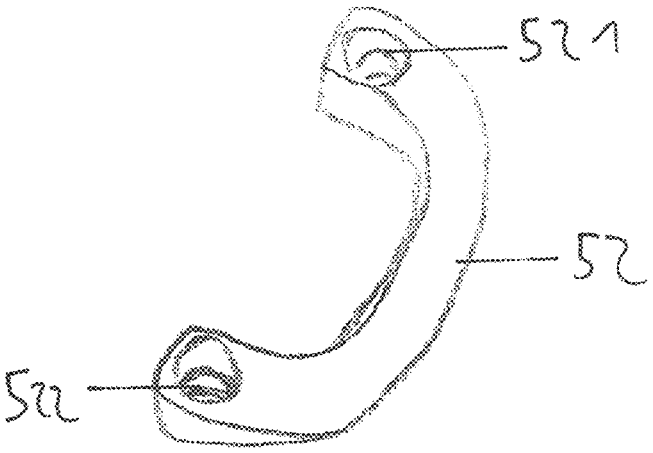

FIG. 13 shows a variant of Adapter 7 in a slimmer version without the end button, FIG. 14 shows the upper section in the form of an attachment member in two embodiments. The components 23 of the adapter 2 and 523 of adapter 5 serve as examples here for illustrative but not definitive purposes. Receptacles 231 and 232; 521 and 522 can be used to receive connecting devices. The attachment member 23, e.g., has a rounded E-shape (top) or a bracket shape 523 (bottom), as a result of which mounting to the tailpiece is simplified. For one thing, the attachment member 23 serves as a support on the instrument while, for another, the limbs of the E-shape encircle the tailpiece. Due to the rounded E-shape, the lower part of the tailpiece is encircled at three points (at the bottom and on both sides). The attachment member 23; 523 can be a bracket-shaped member. The rounded outer limbs of the E-shape or of the bracket are bent towards the axis of symmetry and rounded. The middle limb of the "E" is shortened. In addition, the free end sections of at least the outer limbs are bent out of one plane such that they overlap an edge web protruding beyond the upper side of the string instrument and thus the adapter 2 or 5 can be securely fixed. The shape has been adapted to allow the attachment member 23; 523 to be "threaded" as easily as possible around the tailpiece. In the case of the closed bracket form 523, the tailpiece cords are routed under the bracket form.

Figure 15:
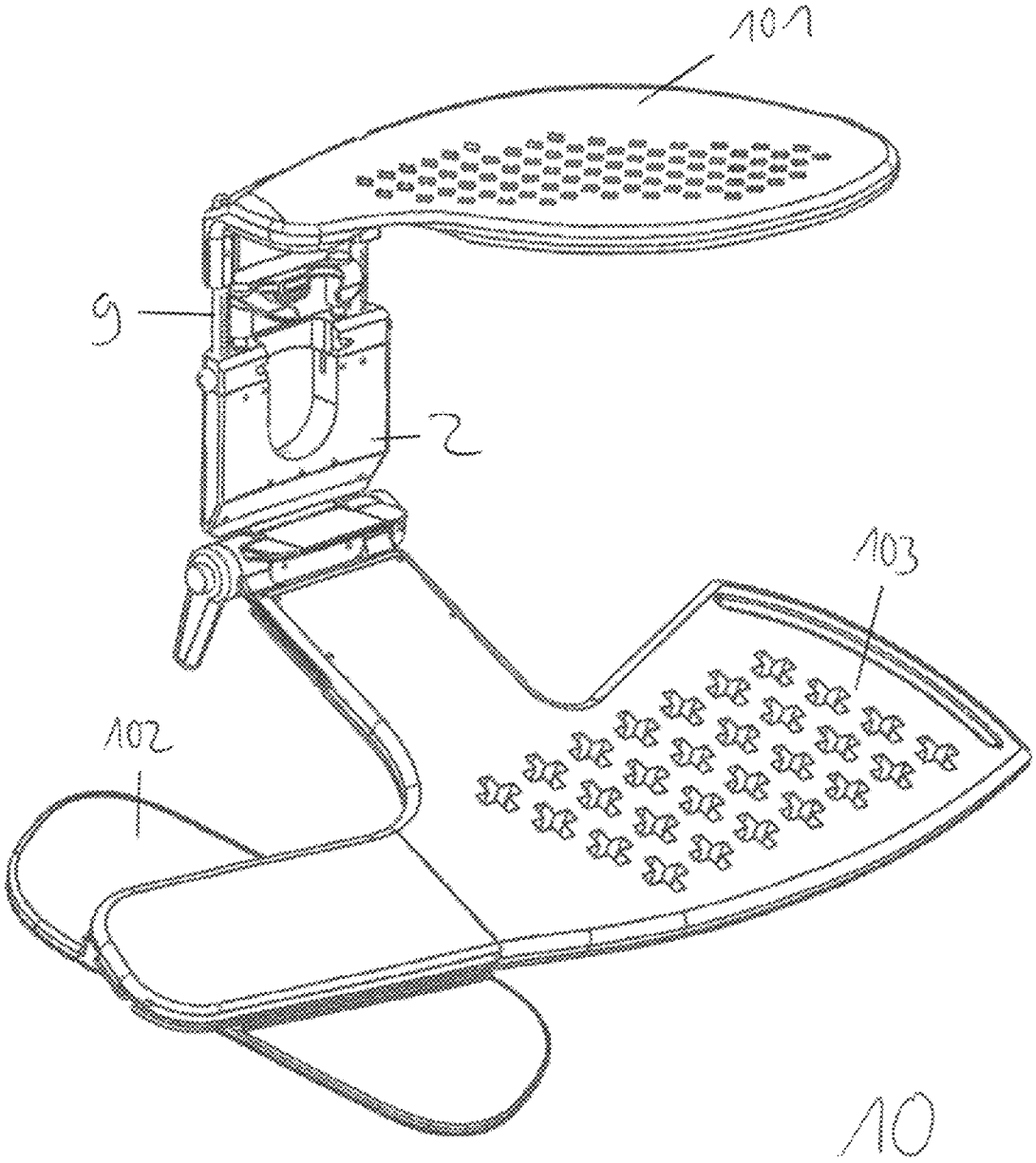
FIG. 15 is an isometric overall view of an illustrative adapter with a height-adjustable carrier module for connection to a support device, which is provided with supports for chin, chest and collarbone.

FIG. 15 shows a schematic representation of the basic construction or the connection of a stringed instrument with any adapter 1 to 7 (in this case adapter 2) as described, for example, in FIGS. 1 to 14, which is connected to a support device 10 via a carrier module 9. The multi-part carrier module 9 is height-adjustable and can thus be adjusted to the length of the neck of the respective user of the instrument. The support device 10 has a clavicle rest 102 and a breast rest 103 in its lower part and a support for the chin 101 in its upper part. These said rests or supports have padding to protect the skin and muscles of the user.

The series of paragraphs below recites various illustrative combinations of features of the present disclosure. These paragraphs are intended to represent a non-limiting presentation of suitable combinations, and are alphanumerically designated for clarity and efficiency.

A0. Adapter (1; 2; 3; 4; 5; 6; 7;) for mounting a support device (10) for a stringed instrument, in particular for a violin or a viola, comprising: a first component (11; 21; 31; 41; 51; 61; 71) having an area for at least section-wise encircling the tailpiece button (8) of the stringed instrument; a second component (12; 23; 32; 42; 52; 62; 72); and a connecting device, characterised in that the first component (11; 21; 31; 41; 51; 61; 71) and the second component (12; 23; 32; 42; 52; 62; 72) are disposed and connected by the connecting device in such a way that the area (113; 313; 413; 513; 611; 621; 713) of the first component (11; 21; 31; 41; 51; 61: 71) encircling the tailpiece button (8) is, at least section-wise, in stationary contact with the tailpiece button (8).

A1. Adapter (3; 6; 7) in accordance with AO, characterised in that the adapter (3; 6; 7) is designed for positive-locking attachment to a stringed instrument, wherein the first component (31; 61; 71) and the second component (32; 62; 72) are in contact with the tailpiece button (8).

A2. Adapter (1; 2; 3; 4; 5; 6; 7) in accordance with any of the previous paragraphs A0 through A1, characterised in that at least the first component (11; 21; 31; 41; 51; 61; 71) and/or the second component (12; 23; 32; 42; 52; 62; 72) is configured to be in contact with the back or with the top of the stringed instrument.

A3. Adapter (1; 2; 3; 4; 5; 6; 7) in accordance with any of the previous paragraphs A0 through A2, characterised in that the connecting device creates an essentially rigid connection between the first component (11; 21; 31; 41; 51; 61: 71) and the second component (12; 23; 32; 42; 52; 62; 72).

A4. Adapter (1; 3; 4; 5; 6; 7) in accordance with any of the previous paragraphs A0 through A3, characterised in that the first component (11) has a base and the area (113; 313; 413; 513; 611; 713) in the form of a circular section is configured in the base, the radius of said circular section corresponding to the radius of the tailpiece button (8).

A5. Adapter (1; 2; 3; 4; 5; 6; 7) in accordance with any of the previous paragraphs A0 through A4, characterised in that the first component (11; 21; 31; 41; 51; 61; 71) has at least a first attachment section (111; 211; 311; 411; 511; 711) for connection to the connecting device and/or a second attachment section (112; 212; 312; 412; 512; 712) for connection to the connecting device.

A6. Adapter (2; 3; 5; 6; 7) in accordance with paragraph A5, characterised in that the first attachment section (311; 511; 711) and/or the second attachment section (312; 512; 712) each have at least one passage with an internal thread for accommodating the connecting device.

A7. Adapter (1; 2; 4; 5) in accordance with any of the previous paragraphs A0 through A6, characterised in that the second component (12; 23; 32; 52) is designed like a bracket for resting on the top or the back of the stringed instrument.

A8. Adapter (1; 2; 3; 4; 5; 6; 7) in accordance with any of the previous paragraphs A0 through A7, characterised in that the second component (12; 23; 32; 42; 52; 72) has at least a third attachment section (121; 231; 321; 421; 521; 721) for connection to the connecting device and/or a fourth attachment section (122; 232; 322; 422; 522; 722) for connection to the connecting device.

A9. Adapter (2; 3; 5; 6; 7) in accordance with paragraph A8, characterised in that the third attachment section (121; 231; 321; 521; 721) and the fourth attachment section (122; 232; 322; 522; 722) each have at least one passage with an internal thread for accommodating the connecting device.

A10. Adapter (3; 7) in accordance with any of the previous paragraphs A0 through A9, characterised in that the second component (12) has an area (323; 723) for making contact with the tailpiece button (8) of the stringed instrument, wherein the first component (31; 71) and the second component (32; 72) are disposed and connected by the connecting device in such a way that the area (323; 723) of the second component is in stationary contact with the tailpiece button (8).

B0. Adapter (2) for mounting a support device (10) for a stringed instrument, in particular for a violin or a viola, comprising: an upper (23), middle (22) and lower section (21), wherein the upper section (23) is configured to be in contact with the top of the stringed instrument, the lower section (21) to be in contact with the back of the stringed instrument, and the middle section (22) serves to connect the upper (23) and lower sections (21).

B1. Adapter (2) in accordance with B0, characterised in that the upper section (23) is designed as an attachment member, wherein the member has a rounded E-shape for at least partially encircling the lower area of the tailpiece of the stringed instrument.

C0. Carrier module (9), which is connected to an adapter (1; 2; 3; 4; 5; 6; 7) in accordance with any of the previous paragraphs A0 through B1, characterised in that the carrier module (9) is suitable for receiving at least one support device (10).

D0. Support device (10) for a stringed instrument, comprising at least one support member for placing against the neck/chin/shoulder region of a user, and an adapter (1; 2; 3; 4; 5; 6; 7), which is connected to the support member, in accordance with any of the previous paragraphs A0 through C0.

The invention claimed is:

1. An adapter for mounting a support device for a stringed instrument, in particular for a violin or a viola, the adapter comprising:

a first bracket having a first area configured to at least section-wise encircle a tailpiece button of a stringed instrument;

a second bracket; and a connecting device, wherein the first bracket and the second bracket are disposed and connected by the connecting device in such a way that the tailpiece button is engaged by both the first bracket and the second bracket and the first area of the first bracket encircling the tailpiece button is, at least section-wise, in stationary contact with the tailpiece button.

2. The adapter of claim 1, wherein the adapter is designed for positive-locking attachment to the stringed instrument, wherein the first bracket and the second bracket are in contact with the tailpiece button.

3. The adapter of claim 1, wherein at least one of the first bracket and the second bracket is configured to be in contact with a back of the stringed instrument.

4. The adapter of claim 1, wherein the connecting device creates a rigid connection between the first bracket and the second bracket.

5. The adapter of claim 1, wherein the first bracket has a base and the first area configured to at least section-wise encircle the tailpiece button is disposed in the base, a first radius of the first area corresponding to a second radius of the tailpiece button.

6. The adapter of claim 1, wherein the first bracket has at least a first attachment section for connection to the connecting device.

7. The adapter of claim 6, wherein the first attachment section has at least one passage with an internal thread for accommodating the connecting device.

8. The adapter of claim 1, wherein the second bracket is configured to rest on a top of the stringed instrument.

9. The adapter of claim 1, wherein the second bracket has at least a second attachment section for connection to the connecting device.

10. The adapter of claim 9, wherein the second attachment section has at least one passage with an internal thread for accommodating the connecting device.

11. The adapter of claim 1, wherein the second bracket has a second area for making contact with the tailpiece button of the stringed instrument, wherein the first bracket and the second bracket are disposed and connected by the connecting device in such a way that the second area of the second bracket is in stationary contact with the tailpiece button.

12. The adapter of claim 1, further comprising a carrier module connected to the adapter, wherein the carrier module is configured to receive at least one support device.

13. The adapter of claim 1, further comprising a support device coupled to the adapter, the support device comprising at least one support member for placing against an upper body region of a user.

14. The adapter of claim 1, wherein at least one of the first bracket and the second bracket is configured to be in contact with a top of the stringed instrument.

15. The adapter of claim 1, wherein the second bracket is configured to rest on a back of the stringed instrument.

16. The adapter of claim 1, wherein the stringed instrument is a violin.

17. An adapter for mounting a support device for a stringed instrument, in particular for a violin or a viola, the adapter comprising:

an upper section including an attachment bracket;

a middle section including a recess; and a lower section;

wherein the upper section is configured to be in contact with a top of the stringed instrument, the lower section is configured to be in contact with a back of the stringed instrument, and the middle section is configured to connect the upper and lower sections to each other, such that the tailpiece button of the stringed instrument is accommodated in the recess of the middle section without contacting the middle section.

18. The adapter of claim 17, wherein the attachment bracket of the upper section has a rounded E-shape configured to at least partially enclose tailpiece cords of the stringed instrument.

19. The adapter of claim 17, further comprising a carrier module connected to the adapter, wherein the carrier module is configured to receive at least one support device.

20. The adapter of claim 17, further comprising a support device coupled to the adapter, the support device comprising at least one support member for placing against an upper body region of a user.

* * * * *